US009410676B1

(12) United States Patent
Vidal et al.

(10) Patent No.: US 9,410,676 B1
(45) Date of Patent: Aug. 9, 2016

(54) LED LIGHT BULB

(71) Applicant: GREEN CREATIVE, LLC, South San Francisco, CA (US)

(72) Inventors: Guillaume Vidal, Mende (FR); Li Hang Ju, Shanghai (CH); Yao Zuo Hong, Shanghai (CH)

( * ) Notice: Subject to any disclaimer, the term of this patent is extended or adjusted under 35 U.S.C. 154(b) by 0 days.

(21) Appl. No.: 14/756,131

(22) Filed: Aug. 6, 2015

Related U.S. Application Data

(60) Provisional application No. 62/177,600, filed on Mar. 20, 2015.

(51) Int. Cl.

| | |
|---|---|
| ***F21V 13/04*** | (2006.01) |
| ***F21V 5/00*** | (2015.01) |
| ***F21V 5/04*** | (2006.01) |
| ***F21V 29/74*** | (2015.01) |
| ***F21V 23/00*** | (2015.01) |
| ***F21V 23/06*** | (2006.01) |
| *F21Y 101/02* | (2006.01) |
| *F21Y 113/00* | (2016.01) |

(52) U.S. Cl.
CPC ..... *F21V 13/04* (2013.01); *F21V 5/008* (2013.01); *F21V 5/045* (2013.01); *F21V 23/003* (2013.01); *F21V 23/06* (2013.01); *F21V 29/74* (2015.01); *F21Y 2101/02* (2013.01); *F21Y 2113/005* (2013.01)

(58) Field of Classification Search
CPC ..... F21V 3/0445; F21V 3/049; F21V 5/002; F21V 5/007; F21V 5/045; F21V 7/09; F21V 13/04; F21V 23/003; F21V 23/004; F21V 23/06; F21V 29/004; F21V 29/2212; F21V 3/0427; F21V 29/74; F21V 29/767
See application file for complete search history.

(56) References Cited

U.S. PATENT DOCUMENTS

| | | | | |
|---|---|---|---|---|
| 7,997,769 | B2 * | 8/2011 | Foo | F21K 9/00 362/249.02 |
| 8,506,103 | B2 * | 8/2013 | Iimura | F21K 9/135 362/254 |
| 8,752,983 | B2 * | 6/2014 | Hussell | F21V 29/02 362/227 |
| 8,760,043 | B2 * | 6/2014 | Gielen | F21K 9/1355 313/46 |
| 8,931,933 | B2 * | 1/2015 | Tong | F21K 9/135 362/218 |
| 9,062,830 | B2 * | 6/2015 | Le | F21V 3/00 |
| 9,335,531 | B2 * | 5/2016 | Athalye | G02B 19/0066 |
| 2011/0216523 | A1 * | 9/2011 | Tong | F21V 3/0481 362/84 |
| 2011/0227102 | A1 * | 9/2011 | Hussell | F21K 9/135 257/89 |
| 2012/0019138 | A1 * | 1/2012 | Maxik | F21K 9/1355 315/35 |

(Continued)

*Primary Examiner* — Hargobind S Sawhney
(74) *Attorney, Agent, or Firm* — James A. Gavney, Jr.; JAG Patent Services

(57) ABSTRACT

An LED lightbulb is disclosed. The LED lightbulb includes an LED array mounted to a circuit board having at least two different sets of LEDs that emit correspondingly different spectra when energized. The LED lightbulb also include a interior reflective surfaces and a dome shaped diffuser lens that eclipses a portion of the LED array. The LED array, the interior reflective surfaces and the dome shaped diffuser lens are position within a cavity formed by a housing with cooling fins and an outside diffuser lens. The LED lightbulb also include a base portion for electrically coupling to a power source of a light fixture that is either an incandescent light fixture or a fluorescent light fixture. In accordance with the embodiments of the invention the LED lightbulb include a driver circuit for providing output power to the LED array from a power source having a ballast or a power source without a ballast.

20 Claims, 2 Drawing Sheets

(56) References Cited

U.S. PATENT DOCUMENTS

2012/0140466 A1* 6/2012 Yang ..... F21K 9/137 362/235
2012/0236572 A1* 9/2012 Negley ..... G02B 1/041 362/311.02
2012/0268930 A1* 10/2012 Lu ..... F21K 9/137 362/235
2013/0301252 A1* 11/2013 Hussell ..... F21V 29/004 362/184
2014/0239794 A1* 8/2014 Hussell ..... F21V 29/02 313/36
2014/0268794 A1* 9/2014 Donofrio ..... F21V 9/08 362/293
2014/0268819 A1* 9/2014 Negley ..... F21V 15/00 362/351
2015/0062909 A1* 3/2015 Progl ..... F21K 9/135 362/294
2015/0233544 A1* 8/2015 Kircher ..... F21V 9/16 362/84

* cited by examiner

LED LIGHT BULB

RELATED APPLICATION

This application claims priority under 35 U.S.C. §119(e) from the U.S. provisional patent application Ser. No. 62/177,600, filed on Mar. 20, 2015, and titled "EFFICIENT LED LIGHTBULB." The provisional patent application Ser. No. 62/177,600, filed on Mar. 20, 2015, and titled "EFFICIENT LED LIGHTBULB" is hereby incorporated by reference.

FIELD OF THE INVENTION

This invention relates to light emitting diode lighting. More particularly, the present invention relates to an efficient light emitting diode lightbulb.

BACKGROUND OF THE INVENTION

A light-emitting diode (LED) is a two-lead semiconductor light source. It is a pn-junction diode, which emits light when activated. When a suitable voltage is applied to the leads, electrons are able to recombine with electron holes within the device, releasing energy in the form of photons. This effect is called electroluminescence, and the color of the light (corresponding to the energy of the photon) is determined by the energy band gap of the semiconductor.

Recent developments in LEDs permit them to be used in environmental and task lighting. LEDs have many advantages over incandescent light sources including lower energy consumption, longer lifetime, improved physical robustness, smaller size, and faster switching. Light-emitting diodes are now used in applications as diverse as aviation lighting, automotive headlamps, advertising, general lighting, traffic signals, and camera flashes. However, LEDs powerful enough for room lighting are still relatively expensive, and require more precise current and heat management than compact fluorescent lamp sources of comparable output.

SUMMARY OF THE INVENTION

The present invention is directed to an LED lightbulb comprising a housing. The housing is a preferably a cone shaped housing with interior cooling fins that extend radially outward along interior sides of the cone shaped housing.

The LED lightbulb also includes an LED array mounted to a circuit board that is a ceramic printed circuit board, a metal printed board or a combination thereof. The LED array preferably includes at least two sets of different LEDs that emit correspondingly different spectra when energized. The LED array and circuit board are preferably mounted at a center bottom portion within the cone shaped housing and are surrounded by a reflective insert or surfaces positioned against inside walls of the cone shaped housing.

The reflective insert or surfaces are made from any suitable material capable of supporting a reflective material or reflective coating and the reflective insert or reflective surfaces are preferably contoured or patterned so that light emitted from the LED array inside the cone-shaped housing is both reflected and scattered.

The LED lightbulb also include an interior or first diffuser lens that eclipses a portion of the LED array within the cone shaped housing. The interior or first diffuser lens is preferably a dome shaped diffuser lens that helps evenly distribute light emitted by the LED array within the cone shaped housing. The interior diffuser lens can be partially transparent, partially opaque, partially reflective or any combination thereof and is preferably concave with respect to the LED array and convex relative an outside or second diffuser lens. The outside or second diffuser lens is preferably a Fresnel lens that couples to the housing and forms a cavity that encloses the LED array and circuit board, the reflective insert or reflective surfaces and the interior or first diffuser lens within the cavity. The outside or second diffuser lens further provides even "wash" or distribution of light emitted from the LED lightbulb.

The LED lightbulb can include a driver circuit coupled to the LED array for converting AC power from a power source of a light fixture to DC output power that is required to energize the LED array. The driver circuit is located within the housing or within a base portion of the LED lightbulb. In accordance with an embodiment of the invention the driver circuit is a sensor driver circuit that senses power characteristics and/or variations from the AC power source and adjusts the DC output power to maintain a stable and/or constant DC output power to the LED array. The LED lightbulb can be configured to be used with a power source having a ballast or a power source without a ballast.

The LED lightbulb also include a base portion for electrically coupling the LED lightbulb to a power source of a light fixture. The base portion includes threaded screw features configured to replace an incandescent lightbulb or a four pin plug connector configured to replace a fluorescent lightbulb.

DETAILED DESCRIPTION OF THE INVENTION

Figure 3:
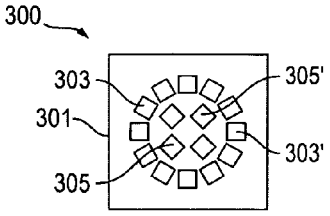
FIG. 3 shows an LED array mounted to a circuit board with two different sets of LED of LED arrays that emit two correspondingly different spectra when energized, in accordance with the embodiments of the invention.
Figure 4A:
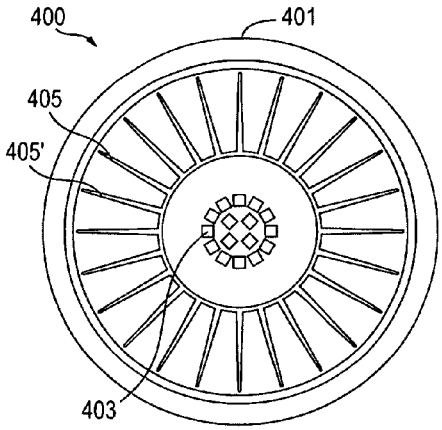
FIGS. 4A-D show views of the steps for assembling an efficient LED lightbulb, in accordance with the method of the invention.
Figure 4B:
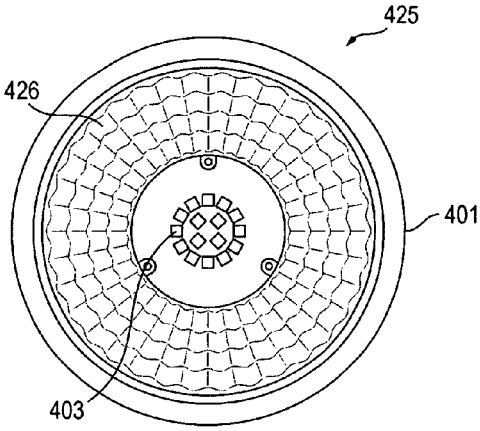
Figure 4C:
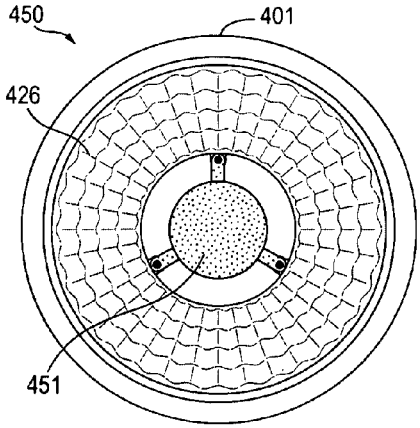
Figure 4D:
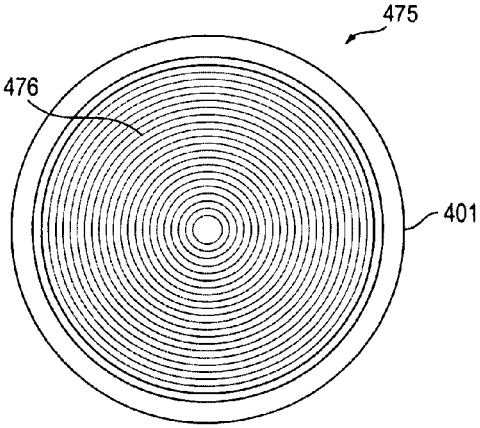

The present invention is directed to an LED lightbulb 100. The LED lightbulb includes a housing 101 that is, for example, cone shaped, with interior cooling fins 106 and 106' that allow for convection and/or air flow to cool the LED lightbulb while powered. The LED lightbulb also includes a base portion 103 for electrically coupling to a power source of a light fixture (not shown). The interior cooling fins 106 and 106' preferable extend radially outward from an LED circuit board 107 and the LED array 300. The LED lightbulb 100 also has a reflective insert 105 that fits within the housing 101 and surrounds the LED circuit board 107 and the LED array 300 (FIG. 3). The reflective insert 105 preferably includes contoured or patterned reflective surfaces, such as illustrated on the reflective insert 426, shown in FIGS. 4B-C.

Figure 1:
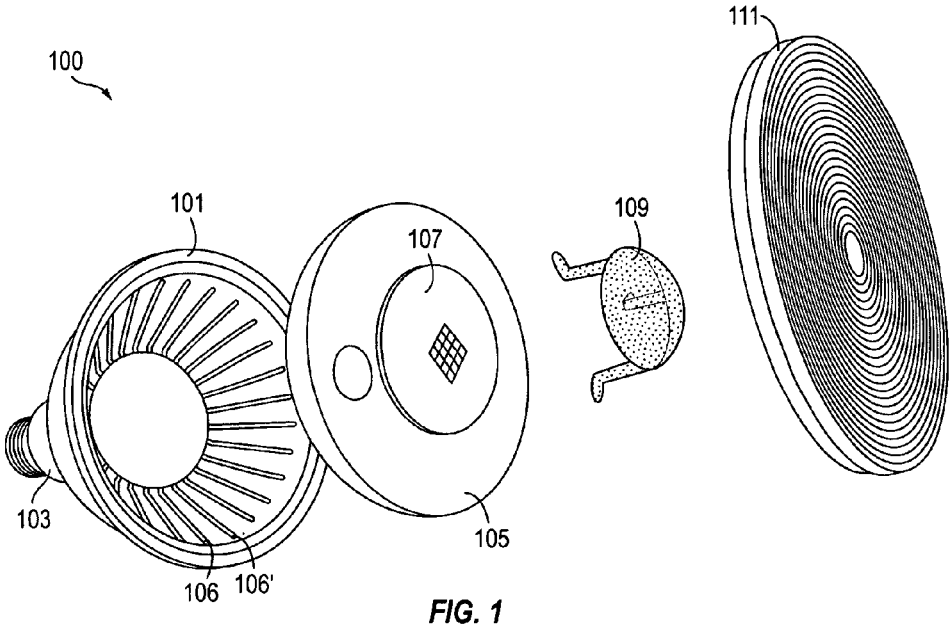
FIG. 1 shows an exploded view of an efficient LED lightbulb, in accordance with the embodiments of the invention.
Figure 2A:
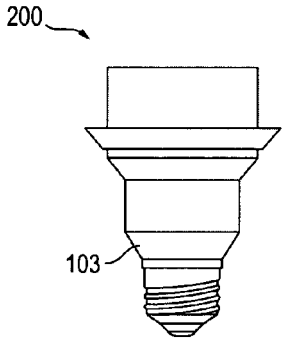
FIGS. 2A-B show bases portions of an efficient LED lightbulb for electrically coupling to a power source of a light fixture, in accordance with the embodiments of the invention.
Figure 2B:
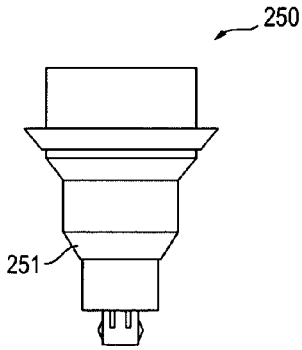

Still referring to FIG. 1, the LED lightbulb further includes a dome shaped diffuser lens 109, as referred to, herein, as a first diffuser lens. The dome shaped diffuser 109 lens is preferably partially transparent, partially opaque and partially reflective and is configured to at least partially eclipse the LED array 300. The dome shaped diffuser lens 109 helps evenly distribute light emitted from the LED array 300 and also reflects a portion of the light emitted from the LED array 300 onto surfaces of the reflective insert 105. The dome shaped diffuser lens 109, or first diffuser lens, is preferably concave with respect to the LED array 300 and convex with respect to a Fresnel lens or a second diffuser lens 111. The Fresnel lens or a second diffuser lens 111 is coupled to the housing 101 and encloses the LED array 300 and circuit board 107, the reflective insert 105 and the first diffuser lens 109 within a cavity formed by the housing 101 and the Fresnel lens or second diffuser lens 111. The Fresnel lens or second diffuser lens 111 provides a broad distribution of the diffused light emitted through the dome shaped diffuser lens 109 and reflected from surfaces of the reflective insert 105. As described above, the LED lightbulb 100 includes a base portion 103 for electrically coupling to the LED lightbulb 100 to a power source of a light fixture. FIG. 2A shows a base portion configuration 200 with threaded screw features 103 that is configured to replace an incandescent lightbulb. FIG. 2B shows a base portion configuration 250 with a four pin plug connector that is configured to replace a fluorescent lightbulb.

The LED lightbulb 100 can also include an LED driver circuit (not shown), and described below. The LED driver circuit converts alternating current (AC) power provided by the power source of the light fixture, and through the base portion 103, into direct current output power to energize the LED array 300. In operation the LED driver circuit is configured provide direct current output power either from power source with a ballast or a power source without a ballast. The LED driver circuit in accordance with the embodiments the invention is configured to sense, detect or measure electrical properties of an alternating current power source and adjust the resulting direct current output power to energize and power the LED array 300. It will be clear to one skilled in the art that any number of base portion configurations for electrically coupling to a power source of a light fixture are within the scope of the present invention.

FIG. 3 shows an LED array 300, in accordance with the embodiments of the invention. The LED array 300 with LEDs 303, 303' 305 and 305' mounted on a circuit board 301. The LED array 300 is electrically coupled to a base portion 103 through an LED driver circuit, as described above. To optimize the efficiency, effect, spectral color and/or wash (distribution) of light emitted by the LED lightbulb 100 (FIG. 1), the LED array 300 preferably includes at least different two sets of LEDs 303 and 303' and 305 and 305' that emit two correspondingly different spectra of light when energized. FIGS. 4A-4D shows steps for the assembling an LED lightbulb, in accordance with the embodiments of the invention. In a the view 400, an LED array on a circuit board 403 electrically coupled to an LED driver, is placed within the housing 401 having interior cooling fins 405 and 405'. As described above the LED array preferably includes at least different two sets of LEDs 303 and 303' and 305 and 305'. In the view 425, a reflective insert 426 is placed within the housing 401 and, thereby, surrounding the LED array on the circuit board 403. The reflective insert 426 preferably includes contoured or patterned reflective surfaces as shown. In the view 450, a dome shaped diffuser lens 451 is placed within the housing 401, such that the dome shaped diffuser lens 451 is surrounded by the reflective insert 426 and eclipses at least a portion of the LED array on the circuit board 403. Then, in the view 475, a Fresnel lens 476 is coupled to the housing 401, such that the reflective insert 426, the LED array on the circuit board 403 and the dome shaped diffuser lens 451 (FIG. 4C) are enclosed within a cavity formed by the housing 401 and the Fresnel lens 476.

The present invention has been described in terms of specific embodiments incorporating details to facilitate the understanding of the principles of construction and operation of the invention. For example, the housing 401 can have any number of shapes including, but not limited to tubular shapes, square shapes and disc shapes. Further, the reflective insert 426 can be separate from the housing 401, or monolithic with the housing 401. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. An LED lightbulb comprising:

a) a housing;

b) an LED array and circuit board that fits within the housing;

c) a reflective insert that fits within the housing and surrounds the LED array and circuit board;

d) an interior diffuser lens that eclipses a portion of the of the LED array; and d) a Fresnel lens that couples to the housing and encloses the LED array and circuit board, the reflective insert and the interior diffuser lens within a cavity formed by the housing and the Fresnel lens.

2. The LED lightbulb of claim 1, wherein the LED array includes at least two sets of LEDs that emit correspondingly different spectra when energized.

3. The LED lightbulb of claim 1, further comprising a base portion for electrically coupling the LED lightbulb to a power source of a light fixture.

4. The LED lightbulb of claim 3, further including a driver circuit configured to energize and power the LED array from the power source of the light fixture with a ballast and a power source of the light fixture without a ballast.

5. The LED lightbulb of claim 3, wherein the base portion includes a four pin plug connector for coupling to the power source of a light fixture.

6. The LED lightbulb of claim 1, wherein the housing is a cone shaped housing with interior cooling fins.

7. The LED lightbulb of claim 1, wherein the interior diffusion lens is a dome shaped diffuser lens that is concave with respect to the LED array and convex with respect to the Fresnel lens.

8. An LED lightbulb comprising:

a) a housing with interior cooling fins;

b) an LED array and circuit board that fits in a middle portion of the housing such that the LED array and circuit board are surrounded by the interior cooling fins;

c) a reflective surfaces adjacent to the interior cooling fins of the housing and around the LED array and the circuit board;

d) a first diffuser lens that eclipses a portion of the LED array; and e) a second diffuser lens that couples to the housing and encloses the LED array and circuit board, the reflective surfaces and the first diffuser lens within a cavity formed by the housing and the second diffuser lens.

9. The LED lightbulb of claim 8, wherein the first diffuser lens is a dome shaped diffuser lens that is concave with respect to the LED array and convex with respect to the second diffuser lens.

10. The LED lightbulb of claim 8, wherein the second diffuser lens is a Fresnel lens.

11. The LED lightbulb of claim 8, wherein the LED array includes at least two sets of LEDs that emit correspondingly different spectra when energized.

12. The LED lightbulb of claim 8, further comprising a base portion for electrically coupling the LED lightbulb to a power source of a light fixture.

13. The LED lightbulb of claim 12, wherein the base portion includes a four pin plug connector for coupling to a power source of a light fixture.

14. The LED lightbulb of claim 8, further including a driver circuit configured to energize and power the LED array from a power source with a ballast and without a ballast.

15. The LED lightbulb of claim 8, wherein the housing is a cone shaped housing and, wherein the interior cooling fins extend radially outward around the LED array and circuit board.

16. An LED lightbulb comprising:

a) a housing with interior cooling fins;

b) an LED array mounted on a circuit board, wherein the LED array includes at least two sets of LEDs that emit correspondingly different spectra when energized;

c) an LED driver circuit that is configured to sense electrical properties of the alternating current power source and is configured to adjust a direct current output to energize and power the LED array;

d) a reflective insert that fits within the housing and over the interior cooling fins of the housing and around the LED array and the circuit board;

e) a first diffuser lens that eclipses a portion of the LED array; and f) a second diffuser lens that couples to the housing and encloses the LED array and circuit board, the reflective insert and the first diffuser lens within a cavity formed by the housing and the second diffuser lens.

17. The LED lightbulb of claim 16, further comprising a base portion for electrically coupling the LED lightbulb to a power source of a light fixture.

18. The LED lightbulb of claim 17, wherein the base portion includes a four pin plug connector for coupling to the power source of a light fixture.

19. The LED lightbulb of claim 16, wherein the housing is a cone shaped housing and wherein the interior cooling fins extend radially outward around the LED array and circuit board.

20. The LED lightbulb of claim 16, wherein the reflective insert has contoured or patterned reflective surfaces.

* * * * *